US006921358B2

(12) United States Patent
Johnston

(10) Patent No.: US 6,921,358 B2
(45) Date of Patent: Jul. 26, 2005

(54) FLEXIBLE EXERCISE APPARATUS

(76) Inventor: Gary Lawrence Johnston, P.O. Box 183, Cowarts, AL (US) 36321

( * ) Notice: Subject to any disclaimer, the term of this patent is extended or adjusted under 35 U.S.C. 154(b) by 265 days.

(21) Appl. No.: 10/355,981

(22) Filed: Feb. 1, 2003

(65) Prior Publication Data

US 2004/0152573 A1 Aug. 5, 2004

(51) Int. Cl.[7] ..... A63B 22/14
(52) U.S. Cl. ..... 482/131; 482/136; 482/51
(58) Field of Search ..... 482/51, 131, 136, 482/142, 146, 147, 907, 95–96, 52–53, 62, 72; D21/688–689

(56) References Cited

U.S. PATENT DOCUMENTS

| | | | | | |
|---|---|---|---|---|---|
| 4,391,441 | A | * | 7/1983 | Simjian | 482/131 |
| 4,948,124 | A | * | 8/1990 | Ghaly | 482/118 |
| 5,433,690 | A | * | 7/1995 | Gilman | 482/146 |
| 5,441,472 | A | | 8/1995 | Johnston | |
| 5,605,525 | A | | 2/1997 | Johnston | |
| 5,967,610 | A | * | 10/1999 | Lin | 297/340 |
| 6,273,841 | B1 | | 8/2001 | Johnston | |
| 6,475,120 | B2 | | 11/2002 | Johnston | |

* cited by examiner

*Primary Examiner*—S. R. Crow

(57) ABSTRACT

A flexible exercise apparatus is provided which enables the user to exercise both upper and lower body muscle groups. The apparatus includes a frame structure means, an upper body engagement means, and a lower body engagement means. The upper and lower body engagement means are coupled to the frame structure means. The user operates the apparatus while in a generally lying position. The user may push and pull backward and forward upon two handle members with their hands, which are part of the hand engagement means. This motion is transferred into a pivoting motion of the lower body engagement means, which is engaged by the legs of the user. The lower body of the user may be used to provide resistance to the upper body of the user. Conversely, the user may pivot the lower body engagement means with their legs, and move said handle members of said upper body engagement means in the foward and backward directions. The upper body of the user may be used to provide resistance to the lower body of the user. The lower body engagement means is pivotally coupled to the frame structure means such that it may be pivoted in the forward, backward, and side directions. The upper body engagement means may be coupled to the frame structure means in different ways, including pivotally coupled, coupled to move backward and forward along a generally linear path, and/or a combination of each. An optional item includes a resistance component for providing resistance to movement of the upper and/or lower body engagement means.

11 Claims, 13 Drawing Sheets

FLEXIBLE EXERCISE APPARATUS

BACKGROUND OF THE INVENTION

This invention relates to a flexible exercise apparatus which has an upright structure that allows the user to perform both upper and lower body exercise routines while in a generally lying down position. This feature allows for a more comfortable and better upper and lower body workout than provided by more conventional combination exercise devices.

U.S. Pat. Nos. 5,441,472, 5,605,525, 6,273,841, and 6,475,120, which were all issued previously to the inventor, Gary Johnston, demonstrate similar types of exercise devices. However, they do not provide as much flexibiltiy as the invention described herewith, and thus do not provide as complete an exercise routine.

SUMMARY AND OBJECTS OF THE INVENTION

It is the object of this invention to provide an exercise apparatus which may provide the user a well balanced upper and lower body combination exercise routine. The main purpose of this application is to demonstrate an apparatus which performs the stated function, and to demonstrate the many options and configurations this apparatus may take on.

Briefly stated, the apparatus that forms the basis of the present invention comprises a frame structure means, an upper body engagement means, and a lower body engagement means. The upper body engagement means and the lower body engagement means are both mounted upon the frame structure means. Also, an optional resistance means may be supported by the frame means, and operatively connect to the upper body engagement means and/or the lower body engagement means.

The design of the apparatus is such that the upper body engagement means is comprises of two handle assemblies, each assembly pivotally mounted to the frame structure means so that the end the user engages with their hand pivots in the generally forward and backward directions, and the opposite end of the assembly pivots in the generally upward and downward directions. The lower body engagement means is pivotally mounted to the frame structure means such that it may pivot not only in the forward and backward directions, but also in the side directions. The upper body engagement means is operatively connected to the lower body engagement means so that pivoting movement in the upper body engagement means produces pivoting movement in the lower body engagement means, and vice versa. The user will position themselves in a generally lying position on the frame structure means, and engage the upper body engagement means with their hands and the lower body engagement means with their feet to operate the device. The user may pivot the upper body engagement means, and resist this motion with the lower body engagement means, or they may pivot the lower body engagement means and resist this motion with the upper body engagement means. The lower body may be utilized to resist movement in the upper body, and the upper body may be utilized to resist movement in the lower body. Also, a conventional type of resistance component may be added to the apparatus to provide an external resistance to the pivoting motion of the upper and lower body engagement means. Other objects, features, and advantages for this invention will be apparent from the following detailed description and the appended claims, references being made to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
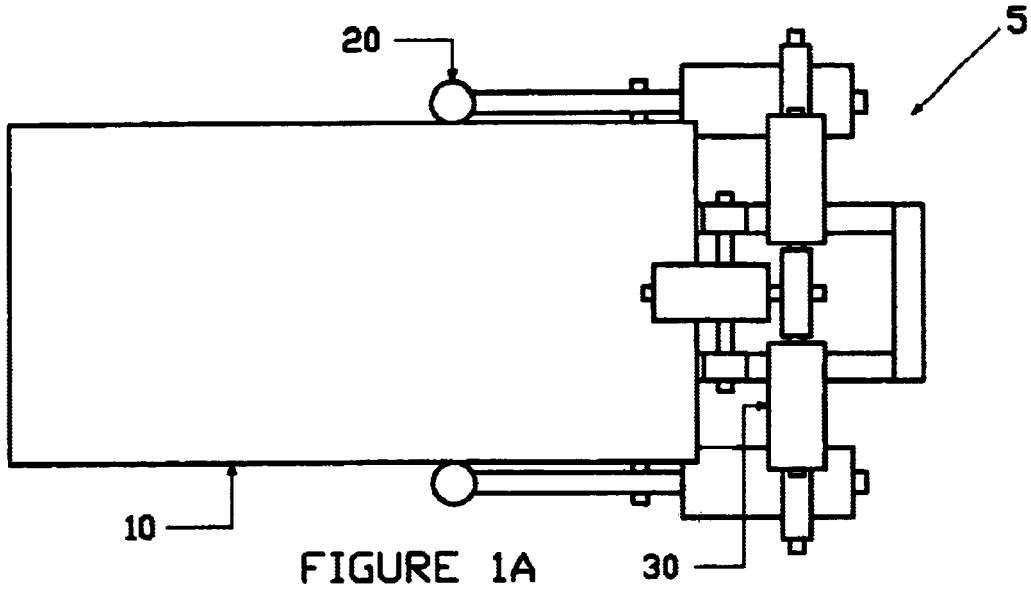
FIG. 1A is a top view of the flexible exercise apparatus.
Figure 1B:
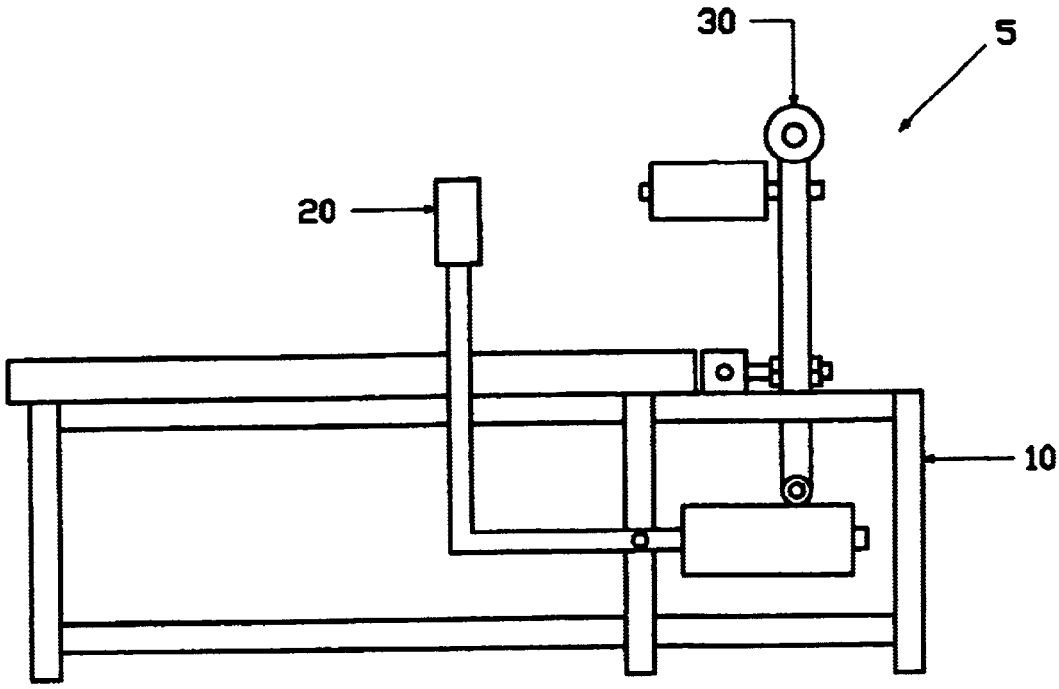
FIG. 1B is a side view of the flexible exercise apparatus.
Figure 1C:
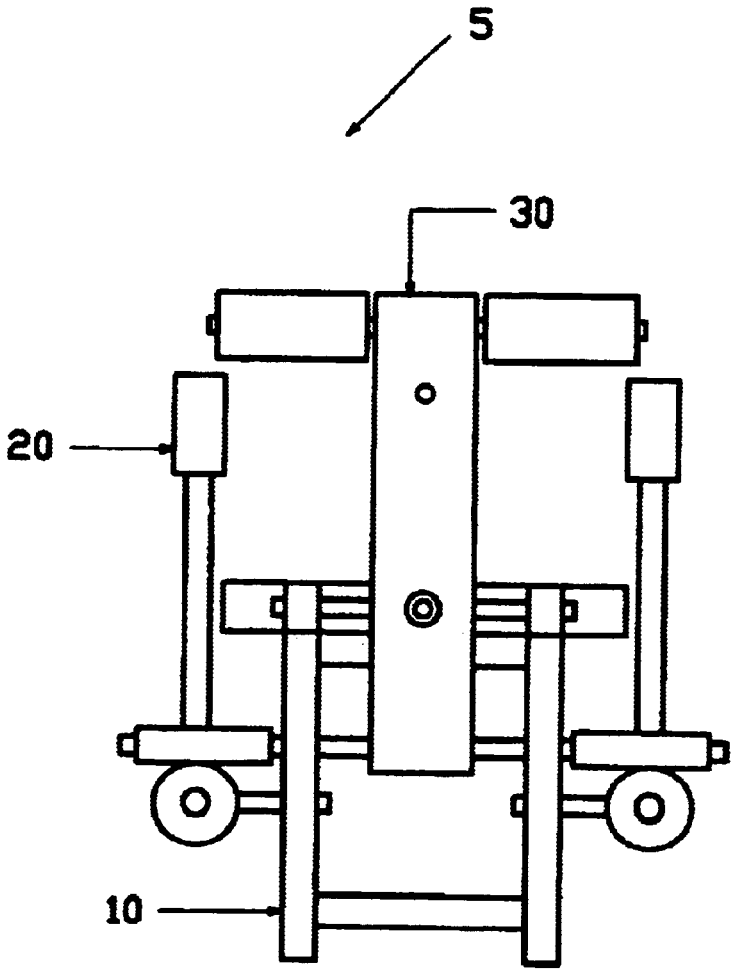
FIG. 1C is a front view of the flexible exercise apparatus.

As best can be seen by references to the drawings, and in particular to FIGS. 1A–1C, the flexible exercise apparatus that forms the basis of the present invention is designated generally by the reference numeral 5, and includes a frame structure means 10, an upper body engagement means 20, and a a lower body engagement means 30. The upper body engagement means 20 and the lower body engagement means 30 are both mounted on frame structure means 10.

Figure 2A:
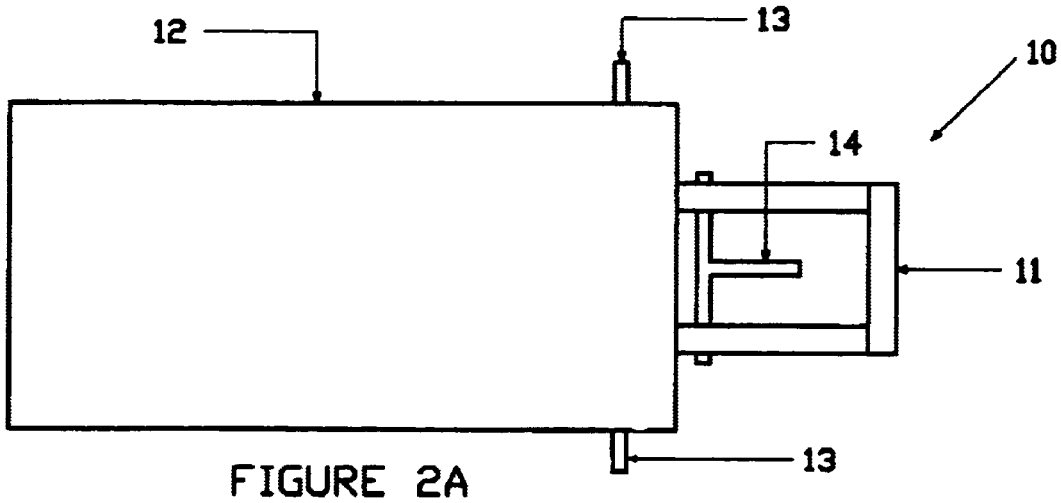
FIG. 2A is a top view of the frame structure means of the flexible exercise apparatus.
Figure 2B:
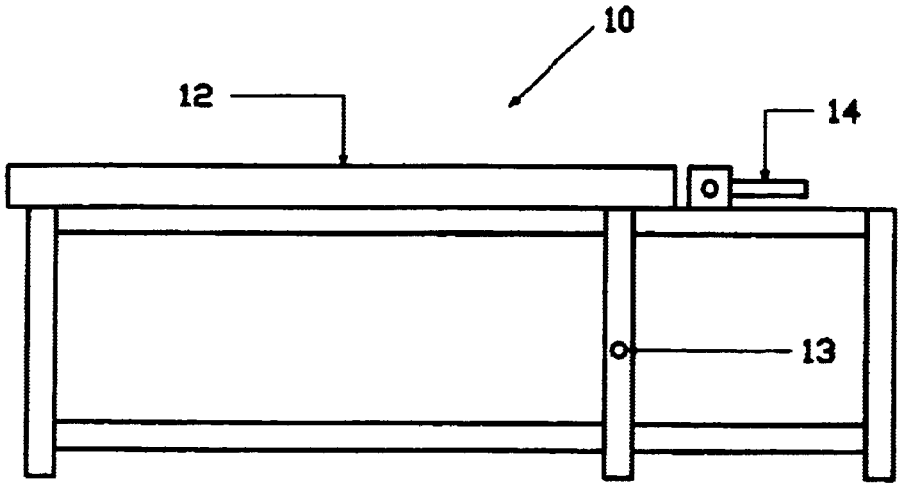
FIG. 2B is a side view of the frame structure means of the flexible exercise apparatus.
Figure 2C:
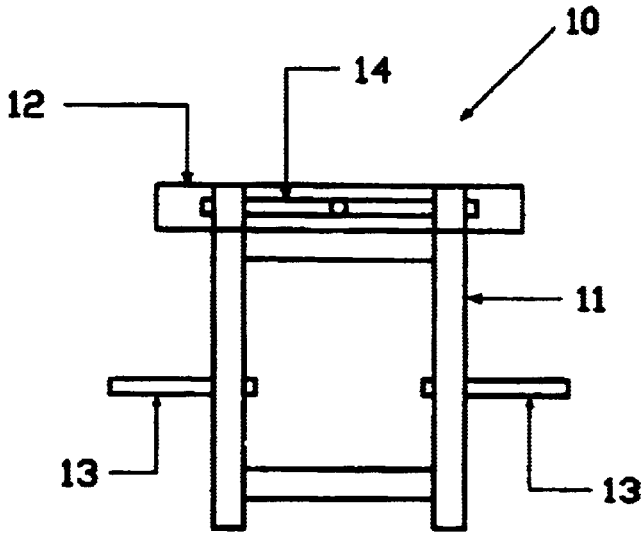
FIG. 2C is a front view of the frame structure means of the flexible exercise apparatus.

As may be seen in FIGS. 2A–2C, the frame structure means 10 comprises a base structure 11, a user support member 12, handle assembly connectors 13, and a lower body assembly connector 14. The handle assemblies of the upper body engagement means 20 pivotally mount to the handle assembly connector 13, while the lower body engagement means pivotally mounts to lower body assembly connector 14. Lower body assembly connector 14 pivotally mounts to the base structure 11.

Figure 3A:
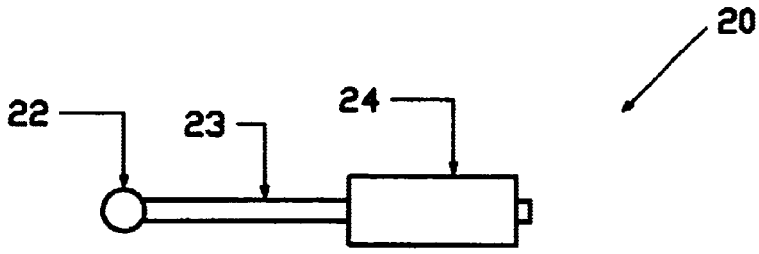
FIG. 3A is a top view of the handle assembly of the upper body engagement means of the flexible exercise apparatus.
Figure 3B:
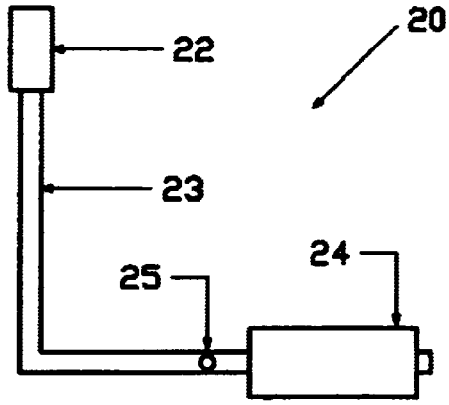
FIG. 3B is a side view of the handle assembly of the upper body engagement means of the flexible exercise apparatus.
Figure 3C:
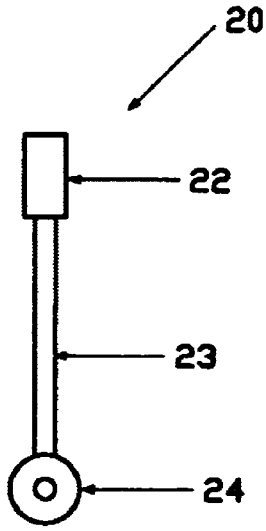
FIG. 3C is a front view of the handle assembly of the upper body engagement means of the flexible exercise apparatus.

As may also be seen in FIGS. 3A–3C, each handle assembly 21 of the upper body engagement means 20 comprises a hand engagement member 22, a support member 23 having opening 25, and a curved member 24. Handle assembly 21 mounts to the handle assembly connector 13 of frame structure means 10 via opening 25. The user will engage hand engagement member 22 with their hand during device operation. Curved member 24 may be a part of support member 23, or may be a separate component. Preferrably, curved member 24 is a separate component rotatably mounted to support member 23.

Figure 4A:
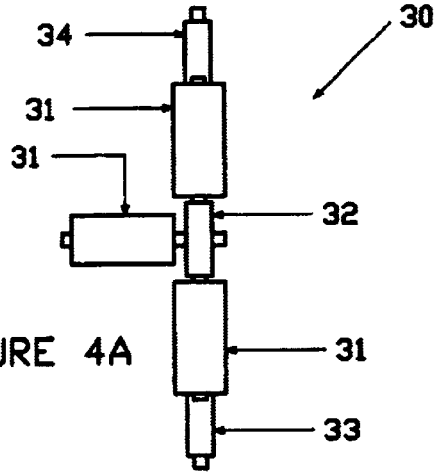
FIG. 4A is a top view of the lower body engagement means of the flexible exercise apparatus.
Figure 4B:
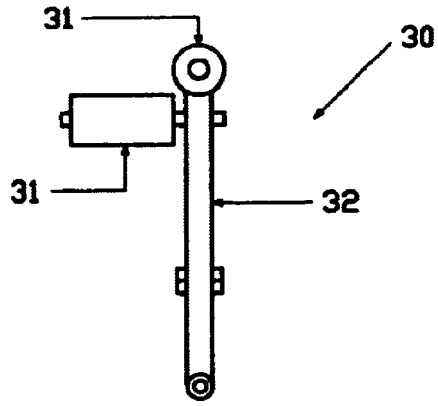
FIG. 4B is a side view of the lower body engagement means of the flexible exercise apparatus.
Figure 4C:
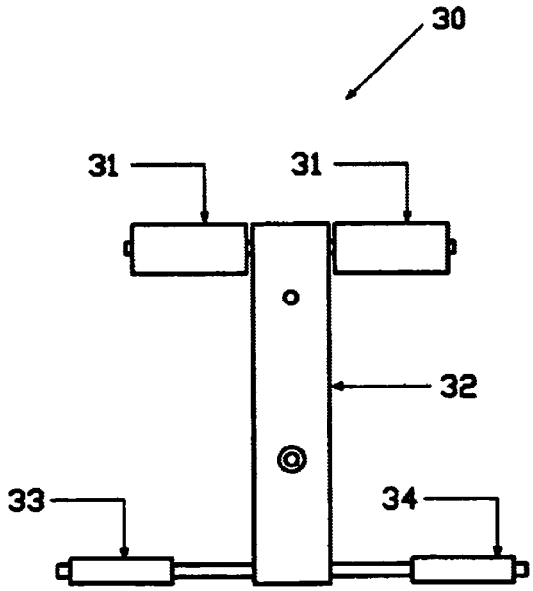
FIG. 4C is a front view of the lower body engagement means of the flexible exercise apparatus.
Figure 5A:
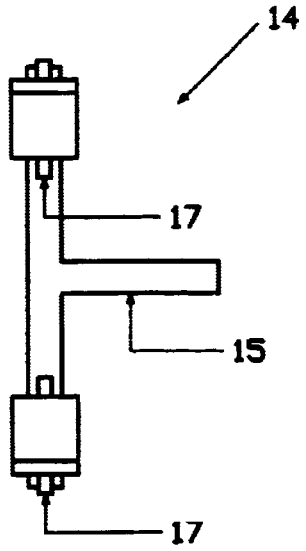
FIG. 5A is a top view of the lower body assembly connector of the frame structure means of the flexible exercise apparatus.
Figure 5B:
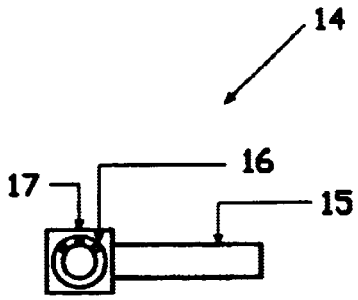
FIG. 5B is a side view of the lower body assembly connector of the frame structure means of the flexible exercise apparatus.
Figure 5C:
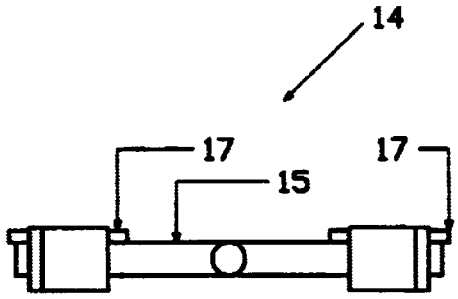
FIG. 5C is a front view of the lower body assembly connector of the frame structure means of the flexible exercise apparatus.
Figure 5D:
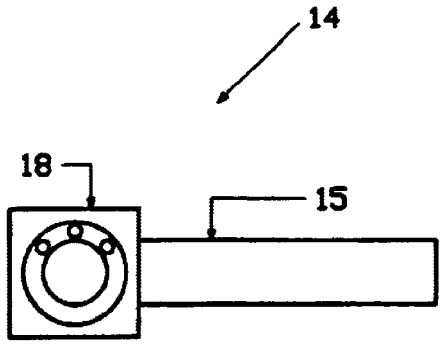
FIGS. 5D, 5E, and 5F are side views of the lower body assembly connector of the frame structure means, demonstrating several positions at which the assembly connector may be secured.
Figure 5E:
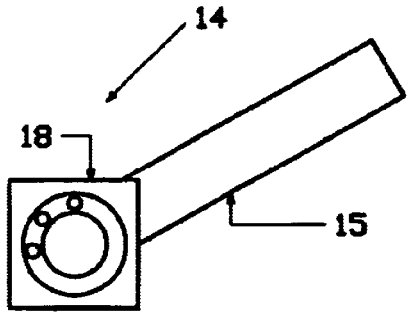
Figure 5F:
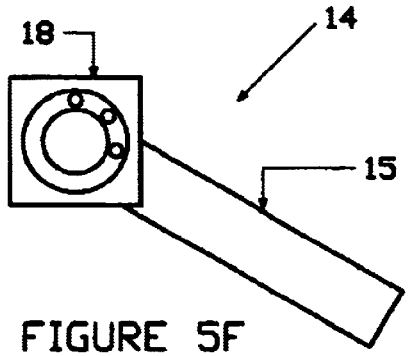
Figure 6A:
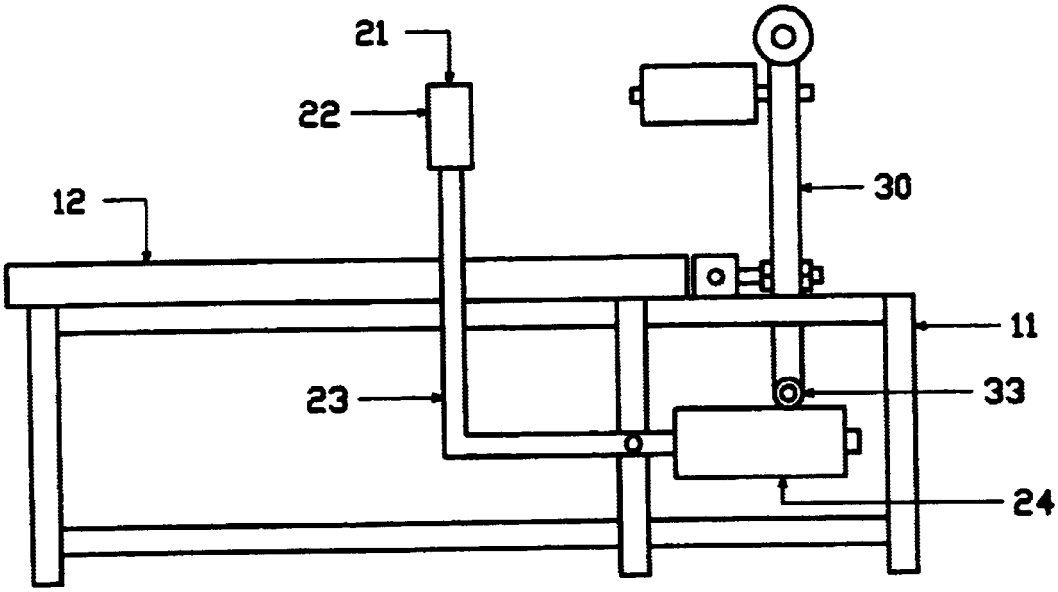
FIGS. 6A and 6B are side views of the flexible exercise apparatus, demonstrating how the upper body engagement means and the lower body engagement means are operatively connected so that pivoting motion in one will produce pivoting motion in the other.
Figure 6B:
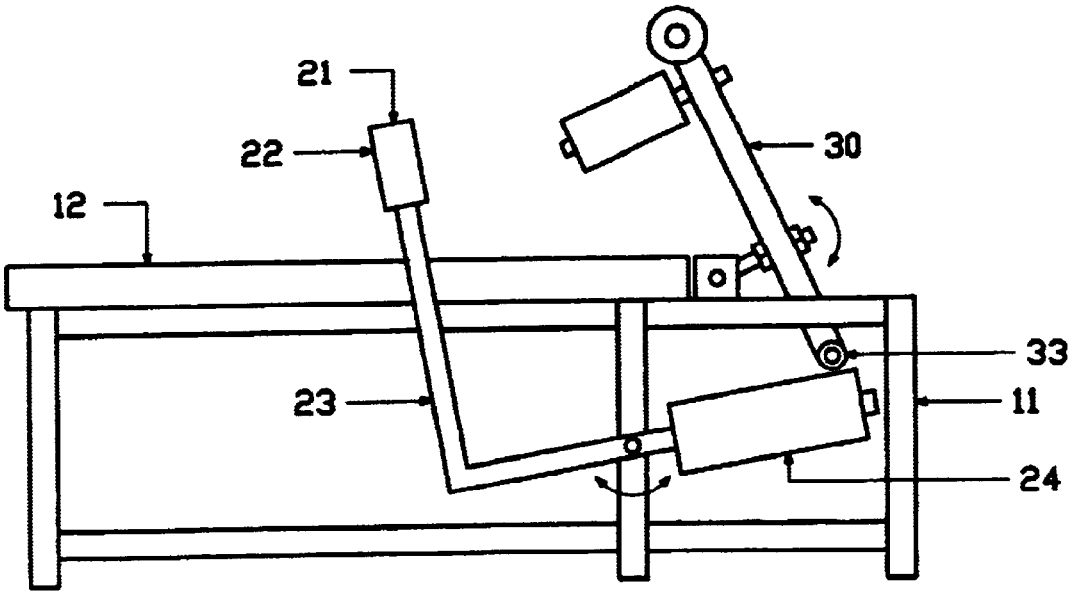
Figure 7A:
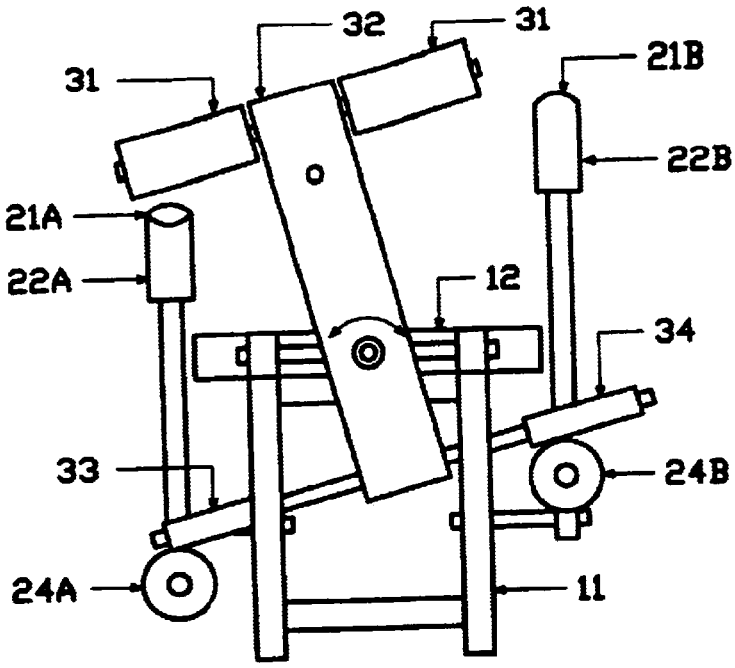
FIGS. 7A, 7B, and 7C are front views of the flexible exercise apparatus, demonstrating how the upper body engagement means and the lower body engagement means are operatively connected so that pivoting motion in one will produce pivoting motion in the other.
Figure 7B:
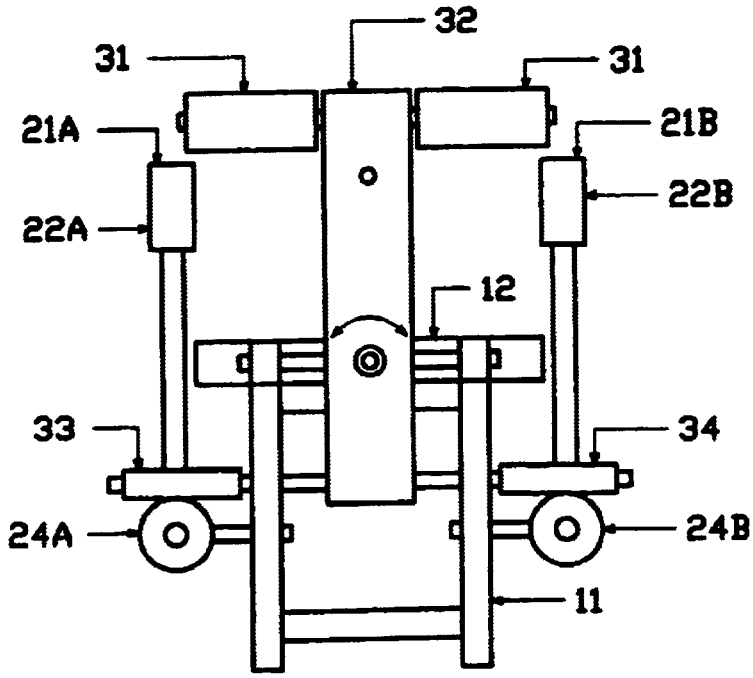
Figure 7C:
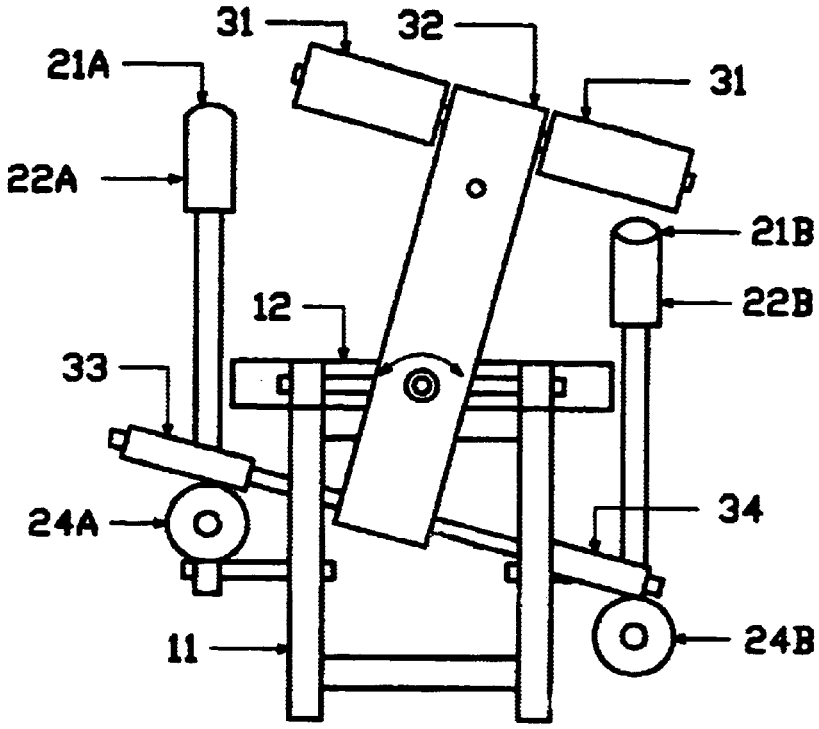

As may be seen in FIGS. 4A–4C, the lower body engagement means 30 is comprised of leg engagement assembly 31, support structure 32, right curved member 33, and left curved member 34. Leg engagement assembly 31 is mounted to the top of support structure 32, while right and left curved members 33 and 34 are mounted to the bottom of support structure 32. Support structure 32 has opening 35, which is used to mount the lower body engagement means 30 to lower body assembly connector 14 of frame structure means 10. Curved members 33 and 34 extend in the generally outward directions. The user will engage the leg engagement assembly 31 with the general thigh area of the leg during device operation. Curved members 33 and 34 will engage curved members 24 of the upper body engagement means. As with the upper body engagement means, it is preferred that curved members 33 and 34 are rotatbly mounted to support structure 32.

As may be seen in FIGS. 5A–5F, the lower body assembly connector 14 of frame structure means 10 comprises a generally T-shaped mounting structure 15, which is pivotally mounted at two of its ends to support structures 18. Support structures 18 are rigidly mounted to base structure 11 of frame structure means 10. The lower body engagement means 30 mounts to the free end of lower body assembly connector 14 via opening 35 of support structure 32. Each end of mounting structure 15, which pivotally mount to support structure 18, may have a series of openings through which a pin or bolt may be place. A corresponding opening may also exist through support structure 18. Thus, mounting structure 15 may be secured at different angles to support structures 18. When a pin or bolt is not used, lower body assembly connector 14 may pivot freely within support structures 18, in the upward and downward directions.

The operation of the flexible exercise apparatus may be seen in FIGS. 6A–7C. The user will lay on the user support member 12, which is mounted upon base structure 11, and engage said upper body engagement means 20 with their hands, and engage the lower body engagement means 30 with the general thigh portion of the legs. Hand assemblies 21A and 21B are pivotally mounted to the right and left side of the base structure 11, so that as the hand engagement members 22A and 22B are pivoted backward and forward, the associated curved members 24A and 24B pivot in the upward and downward directions. Curved members 24A and 24B of the upper body engagement means 20 operatively engage the respective curved members 33 and 34 of the lower body engagement means 30.

Thus as the right hand engagement member 22A is pulled backward by the right hand of user, the associated right curved member 24A will move upward. Since right curved member 24A of the upper body engagement means 20 is in contact with the right curved member 33 of lower body engagement means 30, right curved member 33 will also move upward, causing the support structure 32 of upper body engagement means 30 to pivot to the left. Also, since left curved member 24B of the upper body engagement means 20 is in contact with the left curved member 34 of lower body engagement means 30, left curved member 34 will also move upward when the user pulls back upon the left engagement member 22B with their left hand, thus causing the support structure 32 of upper body engagement means 30 to pivot to the right.

Since the support structure 32 of the upper body engagement means 30 is mounted to the lower body assembly connector 14, and lower body assembly connector 14 is pivotally mounted to base structure 11 using mount structure 15, the support structure 32 may also pivot in the forward and backward direction as the support structure 32 pivots in the side directions. If the lower body assembly connector 14 is secured to the mount structure 15 via a pin or bolt, instead of being free to pivot, the support structure 32 may only pivot in the side directions. This greatly increases the flexibility of the apparatus. The user may engage the leg engagement assembly 31 of lower body engagement means 30 with the general thigh area of the leg, and provide resistance to the pivoting motion of the handle assemblies using their lower body muscle groups.

The opposite may also hold true. The user may engage the leg engagement assembly 31 of upper body engagement means 30, and produce the pivoting motion of the support structure 32 of upper body engagement means in the forward, backward, and side directions. Again, the directions of pivot will depend upon whether or not the lower body connection assembly is secured to or pivotally mounted to the mount structure 15. Thus, the user may engage the right and left hand engagement members with their hands, and provide resistance to the pivoting motion of the lower body engagement means 30 using their upper body muscle groups.

As may also be seen, pulling backward upon right hand engagement member 22A will cause the support structure 32 of lower body engagement means 30 to pivot to the left. This causes left hand engagement member 228 to move in the forward direction. The opposite holds true in that pulling the left hand engagement member 22B in the backward direction will cause right hand engagement member 22A to move forward. However, the user may also pull backwards upon both the right and left hand engagement members 22A and 22B at the same time, and if the lower body assembly connected 14 is pivotally mounted to mount structure 15, the support structure 32 of upper body engagement means 30 will pivot backward. The user may pull backward upon the right and left hand engagement members 22A and 22B with a different force, so that the support structure 32 of lower body engagement means 30 may pivot backward and also pivots towards the side of the smaller force.

As mentioned previously, it is desirable that both the right and left curved members 24A and 24B of the upper body engagement means 20 are separate components which rotatably mount to the ends of right and left support members 23A and 23B. It is also preferrable that right and left curved members 33 and 34 of lower body engagement means are separate components which rotatably mount to the support structure 32 of lower body engagement means 30. This is so that as the respective right and left curved members come in contact with one another, they roll against one another, and create a smooth motion. However, it is possible that the curved members 24A and 24B be an actual part of the support members 23A and 23B, and the curved members 33 and 34 be an actual part of support structure 32, but the movement of the respective curved member against one another will more than likely not be as smooth. It is also possible to utlize non-curved members, but relative movement will not be near as smooth.

It is also possible to have an external resistance means 50 operatively connected to the upper body engagement means and/or the lower body engagement means, to provide an external resistance to the pivoting motion of the right and left handle assemblies 21A and 21B, and the support structure 32. This may be any of the more common types of resistance components, such as a magnetic or electromagnetic flywheel, and have a convetional type of resistance knob. For example, a chain and sprocket assembly 51 may mount to the apparatus, with one sprocket mounted on support structure 32 so that as the support structure 32 moves in the side directions, the sprocket will turn and cause the other sprocket, which is rigidly mounted to the resistance component 52, to also turn. The resistance component 52 will also turn, and the amount of resistance in the resistance component 52 may be varied by an associated conventional resistance knob. The resistance component 52 would need to be secured to the frame structure means so that it does not pivot in the side directions, but does pivot in the forward and backward directions. This could be accomplished by having an extended lower body assembly connector 14, upon which the resistance component would mount. The resistance component 52 would pivot in the forward and backward directions, in conjunction with the lower body assembly connector 14. The resistance component 52 would not pivot in the side directions, since the lower body assembly connector 14 does not pivot in the side directions. Therefore resistance will be felt by the user as they pivot both the upper and lower body engagement means, since they are operatively connected to one another.

Figure 8:
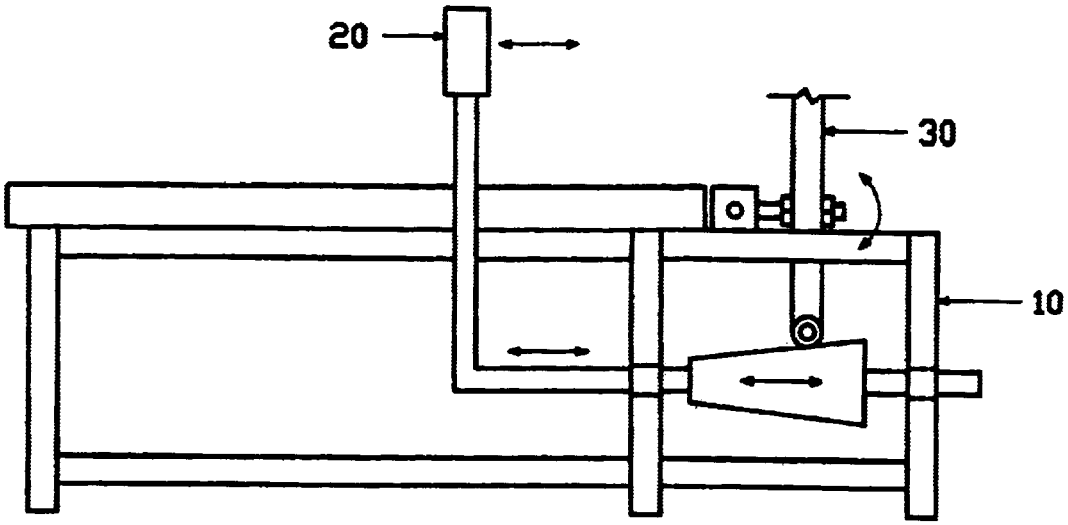
FIGS. 8 and 9 demonstrate additional versions of the flexible exercise apparatus, which perform generally the same function as the original version.
Figure 9:
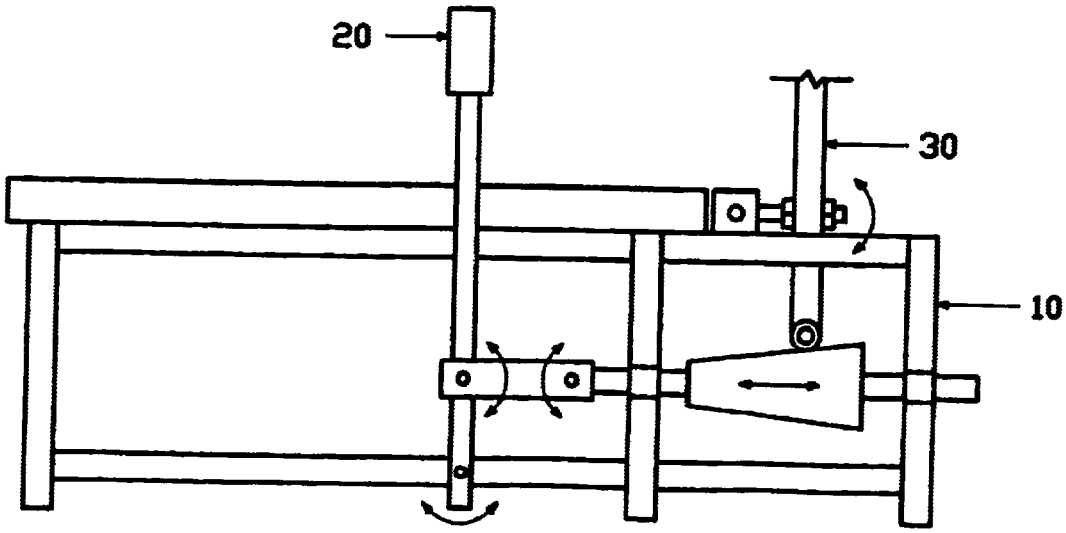
Figure 10:
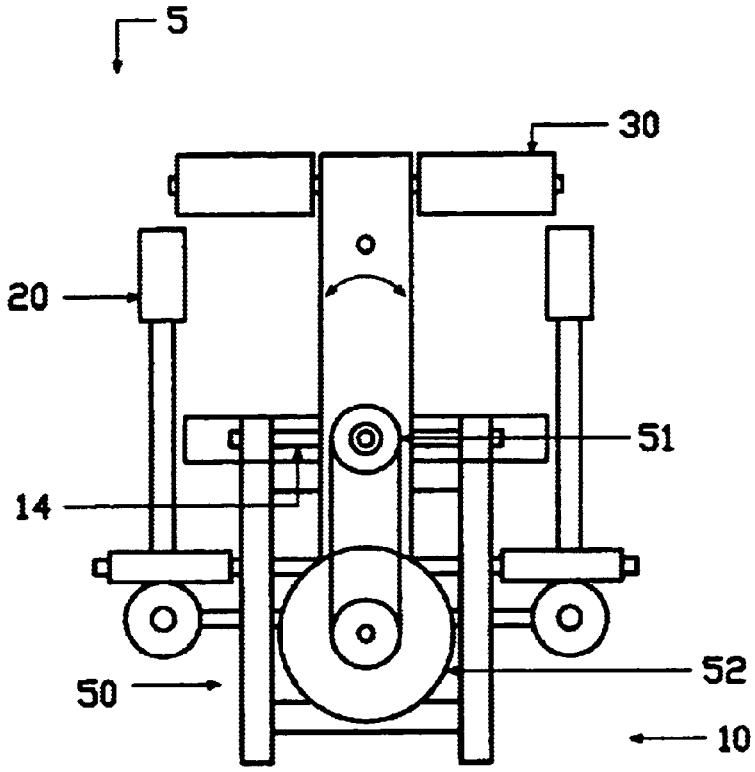
FIG. 10 demonstrates an optional resistance component which may be part of the flexible exercise apparatus.

FIGS. 8 and 9 demonstrate additional versions of the flexible exercise apparatus. FIG. 8 demonstrates a handle assembly which is coupled to the base structure so that it moves in the backward and forward direction, along a generally linear path. The curved members of the upper body engagement means have a varying contour, so that this version performs similar to the original version. As the user pulls back on the right handle assembly, the lower body engagement means 30 pivots to the left, and vice versa. FIGS. 9 demonstrates still another version, in which part of the handle assembly is pivotally mounted to the base structure, while a second part is coupled to the base structure so that it only moves in the forward and backward directions, along a generally linear path. Again, the curved members of the upper body engagement means must have a varying contour for the device to operate as intended.

It is also possible to have changing contours on the curved members of the upper body engagement means and/or the lower body engagement means in the original version of the flexible exercise apparatus. This would allow the velocity and acceleration at which the hand engagement assemblies and the support structure pivot to vary during the operation of the apparatus. Also, various blocks or stops may be added to the apparatus to limit the amount of pivot in the upper and lower body engagement means.

Many variations of the flexible exercise apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A flexible exercise apparatus comprising:

a frame structure means comprising a base structure with a user support member mounted thereon, and an engagement support member pivotally coupled to the forward end of said base structure;

an upper body engagement means comprising a right handle assembly and a left handle assembly, said right handle assembly coupled to the right side of said base structure of said frame structure means, said left handle assembly coupled to the left side of said base structure of said frame structure means, each of said handle assemblies having a hand engagement member, said hand engagement members moveable independently of one another in the forward and backward directions;

a lower body engagement means comprising a generally upward extending support structure pivotally mounted to said engagement support member of said frame structure means, said support structure having leg engagement members mounted to its top end, and right and left assembly engagement members mounted to its bottom end:

whereby said right handle member may engage said right handle assembly engagement member and said left handle member may engage said left handle assembly engagement member, such that moving said right handle member in the backward direction may produce pivoting motion of said support structure of said lower body engagement means in the left side direction, such that moving said left handle member in the backward direction may produce pivoting motion of said support structure of said lower body engagement means in the right side direction, and such that moving said right and left handle members simultaneously in the backward direction may produce pivoting motion of said support structure of said lower body engagement means in the backward direction; whereby a user may position themselves in a generally lying position on said user support member of said frame structure means, engage said upper body engagement means with their hands, engage said lower body engagement means with their legs, and use the upper body engagement means to produce pivoting motion in said support structure of said lower body engagement means and conversely use said lower body engagement means to produce forward and backward motion in said handle members of said upper body engagement means.

2. The flexible exercise apparatus as claimed in claim 1, said engagement support member of said frame structure means pivotally mounted to said base structure of said frame structure means such that the pivoting motion of said engagement support member is in the generally upward and downward directions.

3. The flexible exercise apparatus as claimed in claim 1, said right and left handle assemblies further comprising support structures and a curved members, each of said support structure being a generally L-shaped member pivotally coupled to said base structure of said frame structure means, said hand engagement member mounted to one end of said support structure, said curved member mounted to the opposite end of said structure, whereby pulling said hand engagement member in the backward direction produces upward movement of said respective curved member.

4. The flexible exercise apparatus as claimed in claim 1, said assembly engagement members of said lower body engagement means being outwardly extending curved members, said curved members of said lower body engagement means operatively engaging said respective curved members of said upper body engagement means.

5. The flexible exercise apparatus as claimed in claim 1 further comprising a resistance component used to provide a resistance to the movements of said upper and lower body engagement means.

6. The flexible exercise apparatus as claimed in claim 3, said curved members of said lower body engagement means being rotatably mounted to said support structure of said lower body engagement means.

7. The flexible exercise apparatus as claimed in claim 1, said right and left handle assemblies further comprising a support structure and a curved member, each of said support structure being a generally L-shaped member coupled to said base structure of said frame structure means to move in the forward and backward directions, along a generally linear path, said hand engagement member rigidly mounted to one end of said support structure, said curved member mounted to the opposite end of said structure member, whereby pulling said hand engagement member in the backward direction produces backward movement of said respective curved member, said curved member having a varying contour.

8. The flexible exercise apparatus as claimed in claim 6, said curved members of said lower body engagement means being rotatably mounted to said support structure of said lower body engagement means.

9. The flexible exercise apparatus as claimed in claim 1, said right and left handle assemblies further comprising a support structure and a curved member, each of said support structure being coupled to said base structure of said frame structure means to move in the forward and backward direction, along a generally linear path, said hand engagement member pivotally mounted to one end of said support structure through a connection means, said curved member mounted to the opposite end of said structure member, whereby pulling said hand engagement member in the backward direction produces backward movement of said respective curved member, said curved member having a varying contour.

10. The flexible exercise apparatus as claimed in claim 8, said curved members of said lower body engagement means being rotatably mounted to said support structure of said lower body engagement means.

11. The flexible exercise apparatus as claimed in claim 2, said engagement support member of said frame structure means being securable at different intervals to said base structure of said frame structure means.

* * * * *